United States Patent [19]

Otaki et al.

[11] 4,292,799

[45] Oct. 6, 1981

[54] SPUN YARN-LIKE TEXTURED YARNS AND PROCESS FOR PRODUCING SAME

[75] Inventors: Yukio Otaki; Kazuo Umeda; Kiyoshi Nakagawa, all of Mishima, Japan

[73] Assignee: Toray Industries, Inc., Tokyo, Japan

[21] Appl. No.: 85,635

[22] Filed: Oct. 17, 1979

[30] Foreign Application Priority Data

Oct. 26, 1978 [JP] Japan ..... 53/131798
Nov. 24, 1978 [JP] Japan ..... 53/144254

[51] Int. Cl.[3] ..... D02G 3/04; D02G 3/24; D02J 3/02

[52] U.S. Cl. ..... 57/246; 57/245; 57/287; 57/289; 57/908

[58] Field of Search ..... 57/6, 7, 24, 204–208, 57/225–228, 239–243, 245, 246, 247, 284, 289, 287, 350–351, 908; 28/252, 271

[56] References Cited

U.S. PATENT DOCUMENTS 3,857,233 12/1974 Cardinal et al. ..... 57/908 X
4,019,312 4/1977 Werrick ..... 57/908 X
4,081,887 4/1978 Holden ..... 28/271
4,145,870 3/1979 Klee et al. ..... 57/908 X
4,218,869 8/1980 Newton ..... 57/908 X

*Primary Examiner*—Donald Watkins
*Attorney, Agent, or Firm*—Austin R. Miller

[57] ABSTRACT

Spun yarn-like textured polyester yarns comprised of two types of polyester multifilament component yarns and having broken filaments, in which textured yarns there is a difference in length between the component yarns, whereby high bulkiness is imparted thereto. The individual filaments of one of the component yarns have a fineness less than those of the other component yarn. The spun yarn-like textured yarns have satisfactory pilling resistance and frosting resistance.

The spun yarn-like high bulky textured yarns can be produced by a process comprising doubling two types of undrawn polyester multifilament yarns having different properties through an intertwisting regulative device and simultaneously draw-texturing the doubled undrawn yarns.

10 Claims, 14 Drawing Figures

SPUN YARN-LIKE TEXTURED YARNS AND PROCESS FOR PRODUCING SAME

BACKGROUND OF THE INVENTION

1. Field of the Invention

The invention relates to spun yarn-like textured yarns useful for yarns for woven and knitted fabrics, and having broken filaments resembling spun yarns, and a process for the production thereof.

2. Description of Prior Art

Attempts have been made to obtain a yarn having broken filaments from a continuous multifilament yarn. There are two methods for producing broken filaments on a continuous multifilament yarn. One is a method of cutting some of the component filaments by bringing the surface of the yarn into contact with a cutting device having a rough surface (see, for example, Japanese Pat. No. 48-15693); the other is a method wherein a doubled yarn consisting of a core component and a covering component is brought into contact with a similar cutting device to mainly cut the filaments of the covering component (see, for example, Japanese laid-open Pat. No. 49-133643). These methods have, however, a drawback in that it is difficult to control the resulting broken filament count since it is difficult to make the performance of the cutting devices uniform and it is necessary to frequently clean the cutting devices.

As utilizing the difference in properties of the material yarns, there is a method wherein a yarn consisting of a multifilament component of a low strength and a multifilament component of an ordinary strength is false twisted, and then, passed through a stream of a high speed fluid to mainly cut the filaments of the low strength component (see, for example, Japanese laid-open Pat. No. 47-30957), and a method wherein two multifilament undrawn yarns having different limiting draw ratios are doubled and, then, subjected to simultaneous draw-texturing at a draw ratio such that the filaments of the yarn of a low limiting draw ratio are cut but the filaments of the yarn of high limiting draw ratio are not cut (see, for example, Japanese laid-open Pat. No. 49-116351). These methods also have drawbacks in that it is difficult to control the broken filament count of the resulting yarn, the resulting yarns are inferior in frosting resistance in the case where filaments of a low intrinsic viscosity are used as the filaments of the low strength component and/or they are inferior in processability due to the frequent occurrence of yarn breakage. Furthermore, the yarns obtained by these methods have insufficient bulkiness. The term "frosting" refers to a fault sometimes appearing in a synthetic filamentary yarn as a whitening phenomena of the component filaments due to their fibrilation.

BRIEF SUMMARY OF THE INVENTION

The principal object of the present invention is to provide a spun yarn-like multifilament yarn having a desirable broken filament count, improved fullness and softness over those of the prior art and satisfactory pilling and frosting resistances.

It is another object of the present invention to provide a process for producing the above mentioned improved spun yarn-like multifilament yarn with a high processability.

According to the present invention, there is provided a spun yarn-like textured yarn comprised of two types of polyester multifilament component yarns A and B, the difference in monofilament denier $\Delta[d]_{B-A}$ of the component yarn B from the component yarn A being not less than 1.8 denier, the monofilament denier of the component yarn A being not more than 1.6 denier, and the textured yarn having a broken filament count of not more than 40 per meter of its length, a crimp stretchability of not more than 23%, a difference in length between the component yarns A and B of not less than 1% and a bulk factor of not less than 9 cc/g.

The present invention also provides a process for producing a spun yarn-like textured yarn as defined above, which comprises passing two types of undrawn polyester multifilament yarns A and B, the difference in natural draw ratio (hereinafter referred to as NDR) $\Delta[NDR]_{A-B}$ of the undrawn yarn A from the undrawn yarn B being not less than 2% or not more than −2%, the monofilament denier of the undrawn yarn A being small enough to be drawn to a monofilament denier of not more than 1.6 denier, the monofilament denier of the undrawn yarn B being greater than the monofilament denier of the undrawn yarn A, separately through a feed roller, simultaneously draw-texturing the undrawn years A and B together while doubling them with substantially identical intertwisting angles immediately after passing through an intertwisting regulative device provided between the feed roller and a heater for fixing the twists, whereby the difference in monofilament denier $\Delta[d]_{B-A}$ of the yarn B from the yarn A is made not less than 1.8 denier, the monofilament denier of the yarn A is made not more than 1.6 denier and some of the individual filaments of the yarn A are partially cut to produce broken filaments, and taking up the draw-textured yarns A and B together.

A feature of the yarn according to the present invention resides in its high bulkiness resulting from the difference in length between the two component yarns A and B and in its softness resulting from the presence of the broken filaments mainly composed of the filaments of the component yarn A. According to a specific embodiment of the present invention, the yarn may comprise as the component yarns B and/or A a multifilament yarn in which the individual filaments have a tri-lobal to octa-lobal cross-section. The yarn may also be made substantially coherent by, for example, subjecting the yarn to interlacing.

A feature of the process according to the present invention resides in the fact that the above-mentioned improved spun yarn-like multifilament yarn having desirable and uniform broken filaments can be obtained by simultaneously draw-texturing two undrawn polyester multifilament yarns of properly different monofilament deniers together while using an intertwisting regulative device, but employing no filament cutting device. In the present process, if desired, substantial coherence may be imparted to the yarn before the taking-up thereof.

DETAILED DESCRIPTION OF PREFERRED EMBODIMENTS

Figure 1A:
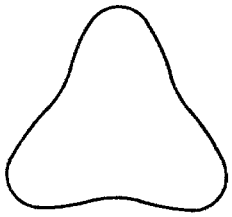
FIGS. 1A to 1D are schematic views illustrating cross-sections of filaments employable for the present invention.

The properties of the spun yarn-like textured yarn as defined in the present invention will become apparent from the following description.

The broken filaments of the spun yarn-like textured yarn of the present invention are mainly composed of the filaments of the component yarn A having a small monofilament denier. The component yarn A having a small monofilament denier of not more than 1.6 denier easily produces broken filaments and provides a soft touch to the resulting yarn. Further, the component yarn A having a small monofilament denier of not more than 1.6 denier provides a satisfactory pilling resistance to the resulting yarn, which results from the low strength of the individual filaments.

The monofilament denier of a multifilament yarn largely affects the softness of a fabric which has been knitted or woven using the yarn. Thus, the smaller the monofilament denier, the higher the softness of the fabric. For example, if a multifilament yarn composed of filaments, each having a monofilament denier of not more than 1.6 denier, is knitted or woven into a fabric, the fabric may have too high a softness and, thus, becomes inferior in stiffness and resilience. In the present invention, the too high softness which may be produced on a knitted or woven fabric from the resulting yarn comprising the component yarn A, having a monofilament denier of not more than 1.6 denier, can be avoided by the presence of the component yarn b having a monofilament denier larger, by not less than 1.8 denier, than that of the component yarn A.

In the present invention, the component yarns A and B, thus, the undrawn yarns A and B to be employed for the production of the yarn of the present invention may preferably have substantially identical intrinsic viscosities. The term "substantially identical intrinsic viscosities" is intended to mean that the difference in intrinsic viscosity between the component yarns A and B or the undrawn yarns A and B is less than 0.06.

The presence of the broken filaments in the yarn results in a smooth touch of a knitted or woven fabric obtained from the yarn. A yarn having a broken filament count of more than 25 per meter, particularly more than 40 per meter, is not preferred, since such a yarn may have many neps and tend to often cause yarn breakage during the production thereof, and in the case of being used for producing a knitted or woven fabric. The yarn according to the present invention preferably has a broken filament count of 3 to 25 per meter.

The crimp stretchability is a measure for indicating the strength and degree of crimp. For obtaining a yarn having a soft feel to the touch, the crimp stretchability, measured as hereinafter described, should be not more than 23%. Preferably, the crimp stretchability is in a range of 15 to 22%.

The difference in length between the component yarns A and B largely affects the bulkiness of the resulting yarn and the bulkiness becomes high as the difference in length increases. The yarn of the present invention is very highly bulky, having a bulky effect due to the difference in length, in addition to the usual bulkiness inherent to a textured yarn. Thus, the yarn can produce a very voluminous feel and a unique touch in a knitted or woven fabric formed from the yarn. If the difference in length is less than 1%, the yarn may have an insufficient bulkiness. Preferably, the difference in length is in a range of from 3 to 12%. The difference in length may be measured as hereinafter mentioned.

The bulk factor is a measure for indicating the bulkiness of a yarn and may be measured as hereinafter mentioned. It is desirable that the yarn have a bulk factor of not less than 9 cc/g, preferably 9 to 18 cc/g.

The yarn of the present invention has desirable mixed crimp configurations resembling a natural fiber yarn, which result from the difference in crimp configuration between the filaments of the component yarns A and B and the difference in monofilament denier between the component yarns A and B.

Figure 1B:
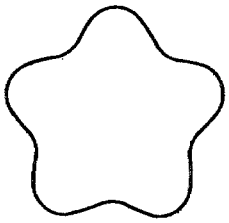
Figure 1C:
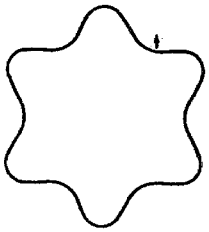
Figure 1D:
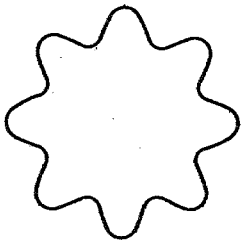

The individual filaments of the component yarns A and B may have tri-lobal to octa-lobal cross-sections, if desirable to obtain a yarn of specific properties. If the component yarns are composed of filaments of tri-lobal cross-sections, the resulting yarn may be highly lustrous and have a silk-like unique appearance and hand. If the component yarns are made of filaments having octa-lobal cross-sections, the glittery effect on the resulting yarn may be lowered, which glittery effect may often be produced on a textured yarn and is, in general, considered to be a fault. Such effects obtainable by the modified cross-sections of the filaments of the component yarn A may be relatively low, since the filaments of the component yarn A have a small monofilament denier. However, in the case where the monofilament denier of the component yarn A is relatively large, e.g., in a range of from 1.2 to 1.6 denier, desirable effects as mentioned above can be obtained by forming the component yarn A with filaments of modified cross-sections. Such filaments having tri-lobal to octa-lobal cross-sections are known, for example, from Japanese Pat. Nos. 36-20770, 42-18579 and 39-22692. In FIGS. 1A to 1D, examples of the cross-sectional shapes of filaments usable for the undrawn yarns to be employed in the production of the yarn according to the present invention are schematically illustrated. FIG. 1A illustrates a filament with a Y-shaped tri-lobal cross-section, which filament can make the resulting yarn highly lustrous. FIGS. 1B, 1C and 1D illustrate filaments with penta-, hexa- and octa-lobal cross-sections, respectively, and these filaments can produce a yarn of lowered or no glittery effect.

Preferably, the yarn according to the present invention may be made substantially coherent. The provision of such coherence makes the yarn easy to handle in a subsequent knitting or weaving process. For example, the unwinding of such a coherent yarn from a package can be easily carried out, under an unwinding tension of not more than 14 g, as in the case of an ordinary textured yarn, notwithstanding the fact that the yarn has broken filaments and has been textured. The coherence may be provided by subjecting the yarn to interlacing, twisting or sizing. Particularly, interlacing is preferred. In the yarn according to the present invention, a "substantially coherent" condition or "substantial coherence" may be defined by: in the case of interlacing, a CF value of not less than 50, measured as hereinafter mentioned; in the case of twisting, a number of genuine twists of not less than 50 T/M, and; in the case of sizing, a coverage of a size of not less than 2.0% based on the weight of the yarn.

In the process according to the present invention, two types of undrawn polyester multifilament yarns properly different in NDR are employed as material yarns. It has been found that the use of the undrawn yarns having such difference in NDR can produce the following very desirable effects.

(1) By simultaneously draw-texturing the two types of undrawn multifilament yarns different in NDR, while doubling the undrawn yarns, it is possible to preferentially cut the component filaments of one of the yarns to produce broken filaments.

(2) By simultaneously draw-texturing the two types of undrawn multifilament yarns different in NDR, while doubling the undrawn yarns, it is possible to provide a difference in length between the two yarns.

(3) If the difference in NDR $\Delta[NDR[_{A-B}$ is not less than 2% or not more than −2%, a yarn having a satisfactorily high bulkiness, resulting from the formed difference in length, can be obtained.

If the difference in NDR $\Delta[NDR]_{A-B}$ is not less than 2%, i.e., the NDR of the undrawn yarn A is greater than that of the undrawn yarn B by not less than 2%, the undrawn yarn A becomes arranged mainly at the outer portion of the doubled and intertwisted yarns during the twisting in the draw-texturing and, thus, the undrawn yarn A is stretched to a greater extent than the undrawn yarn B, whereby the yarn A becomes longer than the yarn B to produce the difference in length as hereinbefore mentioned. Contrary to this, if the difference in NDR $\Delta[NDR]_{A-B}$ is not more than −2%, i.e., the NDR of the undrawn yarn B is greater than that of the undrawn yarn A by not less than 2%, the undrawn yarn B becomes arranged mainly at the outer portion of the doubled and intertwisted yarns during the twisting in the draw-texturing and, thus, the undrawn yarn B is stretched to a greater extent than the undrawn yarn A to produce the difference in length. The difference in length becomes larger as the absolute value of the difference in NDR $\Delta[NDR]_{A-B}$ increases. To obtain a yarn having a bulkiness sufficient for it to be used as the material yarn for a knitted or woven fabric, the absolute value of the difference in NDR should not be less than 2%, preferably 5 to 25%.

The behavior of the multifilament yarns A and B during the twisting in the draw-texturing is as mentioned above. However, it is believed that, practically, there may occur a complex disorder in the migration of the filaments within the filament bundle. In this regard, the filaments of the multifilament yarn A having a relatively low strength may be preferentially cut, at their weak points, by the disorder in the filament migration to produce broken filaments. As a result a yarn having a desirable broken filament count can be obtained without using a specific device for producing broken filaments such as a cutting device.

In the process according to the present invention, the undrawn yarn A to be used as a material yarn preferably has a monofilament denier of 0.8 to 6.0 denier, particularly 1.2 to 4.5 denier, while the undrawn yarn B preferably has a monofilament denier of 5.0 to 26.0 denier, particularly 6.0 to 22.0 denier. Preferably, the ratio of the total denier of the undrawn yarn A to the undrawn yarn B is 3:1 to 1:3, particularly 1:1.

The polyester multifilament yarns usable for the present invention include multifilament yarns of polyethylene terephthalate, polyethylene hydroxybenzoate and copolymers containing more than 70% of these repeating units, as well as multifilament yarns of the polyesters containing a copolymerized third component. These polyesters preferably have an intrinsic viscosity of not less than 0.56, particularly not less than 0.60, from the point of view of the fiber-forming properties of the polyesters or the practical performances of the resulting product yarns or fabrics.

The term "undrawn yarn", as used herein, is intended to include not only an undrawn yarn spun at a usual spinning speed (for example, 800 to 1500 m/min) but, also, a preoriented yarn obtained by spinning at a higher spinning speed.

The NDR of the undrawn multifilament yarns A and B depend upon the combination of the spinning speed, monofilament denier and cross-sectional shape of filaments of the respective undrawn yarns. That is to say, the NDR becomes lower as the monofilament denier decreases in the case where the spinning speed is constant, while the NDR becomes lower as the spinning speed increases in the case where the monofilament denier is constant. Therefore, it is possible to obtain a desired total denier, monofilament denier and the like, of each of the undrawn yarns A and B, by properly controlling the spinning conditions, such as the spinning speed and the like, so that the $\Delta[NDR]_{A-B}$ falls within a predetermined range.

The combination of different types of undrawn yarns A and B should preferably be selected so that the component yarns A and B of the resulting textured yarn have substantially identical dyeability. The difference in dyeability between the component yarns A and B can be controlled by regulating the difference in monofilament denier between the component yarns A and B and the difference in NDR between the undrawn yarns A and B. Thus, it is preferable that, if the difference in monofilament denier is to be 1.8 to 3.5 denier, the difference in NDR be in a range of 5 to 25%.

In the process according to the present invention, an intertwisting regulative device is employed to ensure the commencement of the intertwisting of the two undrawn yarns A and B separately fed through a feed roller with substantially identical intertwisting angles. The intertwisting regulative device should be provided between the feed roller and a heater for fixing the twists imparted by a false-twister, so that the intertwisting of the two yarns can be started before the stretching of the yarns is started at the point the yarns are brought into contact with the heater. As such an intertwisting regulative device, a pin, a pair of snail wires, a rod and the like may be employed.

The intertwisting regulative device should preferably have a surface of a low friction coefficient such as having a degree of surface roughness of 0.5 to 10S (according to Japanese Industrial Standard B 0601). A device such as a pin, rod or the like may be used in such a manner that it is inserted between the two yarns, while a device such as a pair of snail wires or the like may be used in such a manner that the passages of the two yarns are separately fixed.

Figure 2A:
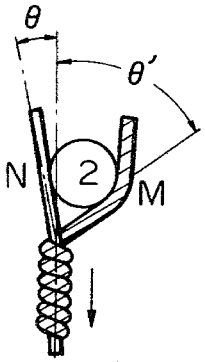
FIGS. 2A and 2B are schematic views illustrating the functions of an intertwisting regulative device.
Figure 2B:
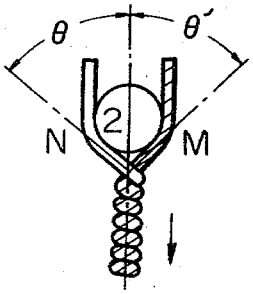

Referring now to FIG. 2B, a circular rod is employed as the intertwisting regulative device according to the invention. As is clearly seen from the figure, the two yarns N and M are started, immediately after the rod, to be doubled and intertwisted with the respective intertwisting angles $\theta$ and $\theta'$. These angles should be substantially identical for achieving the purpose of the present invention. Particularly, the difference between the angles $\theta$ and $\theta'$ should be within 10°, preferably within 5°.

Similar means have hitherto been known, for example, in Japanese laid-open Pat. No. 49-50259 and Japanese laid-open Pat. No. 52-1126. However, these known means are used for the purpose that, upon the intertwisting of two yarns, one yarn is wound around the other yarn. Thus, as is seen from FIG. 2A, two yarns N and M are doubled and intertwisted with largely different intertwisting angles $\theta$ and $\theta'$ immediately after such a means.

In the process according to the present invention, if the means as mentioned above is employed instead of the intertwisting regulative device, i.e. if the intertwisting angles of the two undrawn yarns A and B are greatly different from each other as is seen in FIG. 2A, the difference in length between the yarns A and B is already produced at the point the intertwisting of the yarns is started and broken filaments are unlikely to be produced on the resulting textured yarn.

It has been found that, if the intertwisting of the two undrawn yarns A and B is started with substantially identical intertwisting angles as is seen in FIG. 2B, broken filaments are desirably produced on the component yarn A during the simultaneous draw-texturing. The use of the intertwisting regulative device in the process of the present invention for the purpose of the commencement of the intertwisting of two yarns with substantially identical intertwisting angles can produce the following further effects. Yarn breakage is unlikely to occur, so that the processability becomes high. A difference in dyeability between the two component yarns is unlikely to be produced on the resulting textured yarn. A uniform broken filament count can be obtained along the yarn length.

Contrary to this, in the case where the intertwisting regulative device is not used, a difference in dyeability between the two component yarns is likely to be produced on the resulting textured yarn; a uniform broken filament count can not be obtained, and; yarn breakage often occurs during the draw-texturing.

A preferred embodiment of the process according to the present invention will now be further illustrated with reference to FIG. 3.

An undrawn polyester multifilament yarn of a relatively small monofilament denier and an undrawn polyester multifilament yarn of a relatively large monofilament denier are separately fed through a feed roller 1. The yarns A and B are doubled together immediately after passing through an intertwisting regulative device 2, provided between the feed roller 1 and a first heater 3 for fixing the twists imparted by a false-twister 5. The doubled yarns A and B are then simultaneously drawn and false-twisted between the intertwisting regulative device 2 and a second roller 6, while passing through the first heater 3, a cooling plate 4 and a false-twister 5. The yarns A and B are then passed through the second roller 6 and, if desired, heat treated by a second heater 7, provided between the second roller 6 and a third roller 8, and then, taken up on a take-up means 10. Indicated by g are yarn guides.

The doubled and intertwisted yarns A and B are subjected to untwisting after being passed through the false-twister 5, and, during this draw-texturing, filament breakage occurs in the component yarn A to produce desired broken filaments and a difference in length between the component yarns A and B is produced. Thus, a spun yarn-like textured yarn according to the invention is obtained.

Figure 4:
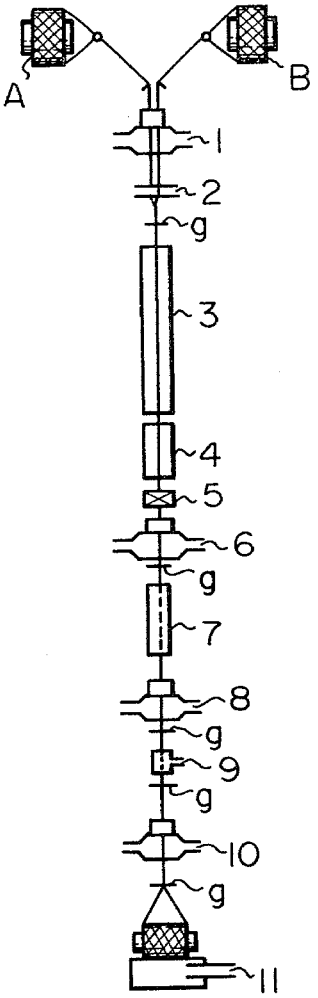
FIG. 4 is a schematic view of an apparatus usable for the practice of another embodiment of the present invention.

In another embodiment, illustrated in FIG. 4, the drawn and false-twisted yarns A and B are passed through an interlacing nozzle 9, provided downstream of the third roller 8, for imparting substantial coherence to the two yarns to form a composite yarn. The composite yarn is then passed through a fourth roller 10 and taken up on a take-up means 11. Instead of the interlacing, twisting or sizing may be carried out for imparting substantial coherence to the yarn, as hereinbefore mentioned. If appropriate, the interlacing nozzle 9 may be provided between the false-twister 5 and the second roller 6, or at an inlet or outlet portion of the second heater 7, or the positions of the interlacing nozzle 9 and the second heater 7 may be interchanged.

If desirable, coning oil may be applied to the yarn before it is taken up.

As the false-twister 5, an external friction false-twister, internal friction false-twister or false-twisting spindle may be employed. In the process according to the invention, it is not necessary to employ any particular means for producing broken filaments. Thus, where a friction false-twister is employed for the draw-texturing, the friction body of the false-twister may be made of soft material such as rubber to produce a desirable broken filament count on the resulting yarn. The use of such a rubber friction false-twister can produce an advantage in that the yarn is unlikely to be harmed by the false-twister and, thus, the strength of the resulting yarn is high. For example, the yarns obtained by the procedure as mentioned hereinafter in Example 1 all had a tensile strength of not less than 3.7 g/d.

As will be understood by the above description, in the process of the present invention, unlike in the conventional processes, the cutting of the filaments is not effected by exposing the multifilament yarn to too high a tensile force. This will be confirmed from the following experimental results.

An undrawn polyethylene terephthalate yarn B of 134.1 denier—18 filaments and an NDR of 46.4% was obtained by spinning a polyethylene terephthalate melt at a spinning speed of 3000 m/min. An undrawn polyethylene terephthalate yarn A of 132.6 denier—62 filaments and an NDR of 52.4% was also obtained by spinning a polyethylene terephthalate melt at a spinning speed of 2600 m/min. These yarns A and B were doubled and draw-textured, at various draw ratios, on an apparatus as illustrated in FIG. 3. The results are shown in Table 1 below.

TABLE 1

| Draw Ratio (times) | Broken Filament Count (counts/m) |
|---|---|
| 1.60 | 7.7 |
| 1.70 | 8.2 |
| 1.80 | 7.0 |
| 1.90 | 5.3 |

It will be apparent from Table 1 that, where the draw ratio (and, thus, the twisting tension) is low, the broken filament count tends to increase slightly. From this, it will be appreciated that, in the process of the present invention, unlike in the conventional processes, the broken filaments are not produced by cutting the filaments under a high tension.

The spun yarn-like textured yarn of the present invention has satisfactory pilling and frosting resistances, and a desirable bulkiness and improved fullness and softness due to the desirable difference in length between the component yarns and the desirable broken filament counts. In the process of the present invention, a desirable spun yarn-like textured yarn can stably and efficiently be obtained without causing yarn breakage and neps.

The properties as discussed herein with respect to the spun yarn-like high bulky textured yarns and starting undrawn yarns are determined by the following methods.

NATURAL DRAW RATIO (NDR)

Figure 5:
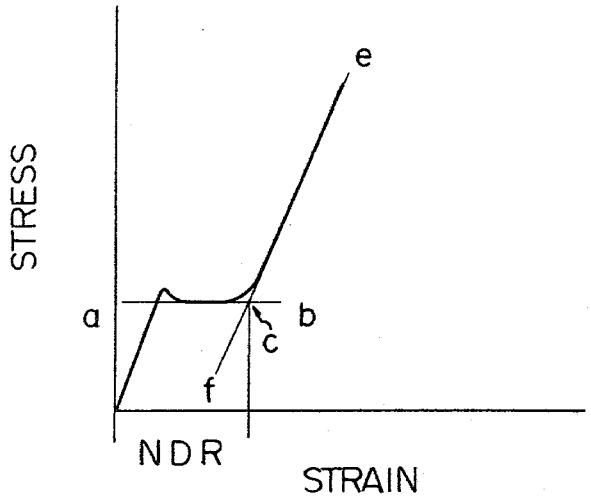
FIG. 5 is a graph illustrating a Stress-Strain curve of an undrawn polyester multifilament yarn for the measurement of an NDR as hereinafter defined.

In FIG. 5, a Stress-Strain curve of an undrawn polyester multifilament yarn is shown. The point indicated by c is the intersecting point of the constant tension extension level (line ab) and the tangent of the second rising portion (line ef). The NDR (%) is determined as the distance between the points a and c.

The difference in NDR is calculated by the equation: $\Delta[NDR]_{A-B}(\%)$ = the NDR (%) of the undrawn yarn A − the NDR (%) of the undrawn yarn B.

The Stress-Strain curve is determined under conditions of a yarn length of 50 mm and a stretching speed of 400%/min.

BROKEN FILAMENT COUNT

Protruded broken filaments are counted with the unaided eye over 10 m of the yarn length and an average number of the counted broken filaments per meter is indicated.

CRIMP STRETCHABILITY 20 m of a sample yarn is formed into a hank of a circuit length of 1 m, a load of 1/15 gram per nominal denier is applied and the hank with the load is heat treated for 5 minutes in an oven at 105°±2° C. The hank is taken out from the oven and allowed to cool to room temperature. Then, a length $\mathbf{l}_a$ of this hank is measured. Thereafter, a load of 4 grams per nominal denier is added to the hank and a length $\mathbf{l}_b$ of this hank is measured. The crimp stretchability is calculated by the following equation.

$$\text{Crimp Stretchability } (\%) = (\mathbf{l}_b - \mathbf{l}_a)/\mathbf{l}_b \times 100$$

DIFFERENCE IN LENGTH

A sample yarn is marked at two points 30 cm apart with the yarn under a load of 0.1 gram/denier. Then, the load is removed and the component yarns A and B are carefully separated from each other. Each of the separated component yarns is loaded with a weight of 0.1 gram/denier and the length between the marked points is measured. The percentage of difference in length between the two component yarns A and B is calculated from the following equation.

$$\text{Difference in Length } (\%) = (L_A - L_B)/L_B \times 100$$

wherein $L_A$ is a measured length of the component yarn A and $L_B$ is a measured length of the component yarn B.

If the separation of the respective component yarns A and B is difficult, the marking of the yarn may be effected over a shorter length of the yarn.

BULK FACTOR

In FIGS. 6A to 6D, a device for the measurement of a bulk factor is illustrated. Two slits 15 are provided in a sample carrier 14 with a distance T of 6 mm (FIG. 6D) between the outer edges of the slits. A flexible fabric tape 16 of a width of 2.5 cm is passed through the slits 15 from one to the other, and a metal piece 17 with a pointer and a weight 18 are connected to the lower portion of the tape 16. The pointer of the metal piece 17 is set to indicate the zero position of a pointer scale 19.

A sample 20 is prepared as follows. A sample yarn of a length of 80 m is formed into a hank of a perimeter of 1 m. The hank is then heat treated by suspending it in an atmosphere of 200° C.±2° C., for 5 minutes, with no load. The sample 20 is prepared by arranging parallel a plurality of thus heat treated hanks so as to produce a total denier of 48,000 denier. For example, four hanks are arranged, parallel if the sample yarn has a total denier of 75 denier.

Figure 6A:
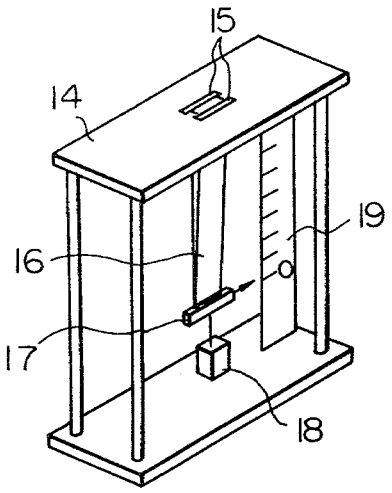
FIGS. 6A to 6D are schematic views of a device for the measurement of a bulk factor as hereinafter defined.
Figure 6B:
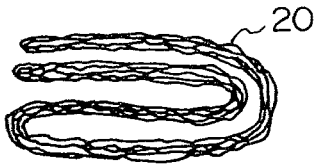
Figure 6D:
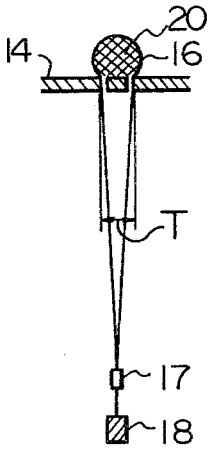
Figure 6C:
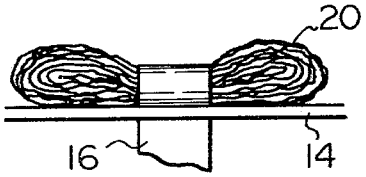

Then, the parallel arranged hanks are folded in four as illustrated in FIG. 6B, and are put between the tape 16 and the sample carrier 14 as illustrated in FIGS. 6C and 6D. A weight of 50 g in total is loaded by the weight 16 and the metal piece with the pointer. Then, the value L (cm) of the pointer scale is recorded. The position of the sample 20 is changed three times and the mean value L is taken.

The bulk factor is calculated by the following equations.

$$\text{Bulk Factor (cc/g)} = \frac{\text{the volume of the yarn covered by the tape } (V)}{\text{the weight of the yarn covered by the tape } (W)}$$

$$V = \frac{(\overline{L})^2}{\pi} \times 2.5$$

$$W = D \times \frac{100}{100 - SH} \times P \times 0.025 \times \frac{1}{9000}$$

in which D is a total denier of the sample yarn before the heat treatment, P is the number of the yarns parallel arranged parallel in the portion covered by the tape, and SH is a dry heat shrinkage (%) of the sample yarn.

The SH is determined as follows. A sample yarn of a length of 80 m is formed into a hank of a perimeter of 1 m and the length $l_1$ (cm) of the hank is recorded under a weight of 0.1 g/denier. The hank is then heat treated by suspending it in an atmosphere of 200° C.±2° C., for 5 minutes, with no load, and the length $l_2$ (cm) of the heat treated hank is recorded also under a weight of 0.1 g/denier. The SH is calculated by the following equation.

$$SH\ (\%) = [(l_1 - l_2)/l_1] \times 100$$

CF VALUE

Figure 7:
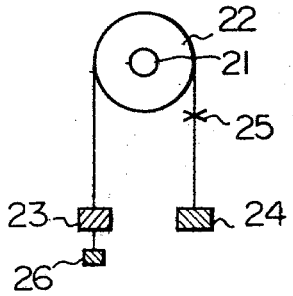
FIG. 7 is a schematic view of a device for the measurement of a CF value as hereinafter defined.

As illustrated in FIG. 7, a sample yarn is hung on a sheave 22 which is freely rotatable around a central axis 21 and two loads 23 and 24 are applied to the two ends of the sample yarn. The respective loads are 0.4 gram per nominal denier. Then, a fixing needle 25 of a diameter of 0.60 mm is pierced at a right angle into the yarn so that the constituent filaments are divided into approximately two equal parts and the needle is fixed. An additional load 26 of 2 grams per monofilament denier is then applied to the left side end (in FIG. 7) of the yarn, whereby the yarn moves counter clockwise (in FIG. 7) around the sheave 22 to a point an interlaced portion of the yarn is caught by the fixing needle to stop the movement of the yarn.

Then, the additional load 26 is removed from the left side end of the yarn and applied to the right side end of the yarn, whereby the yarn moves clockwise around the sheave 22 to a point where another interlaced portion of the yarn is caught by the fixing needle to stop the movement of the yarn. The speed of movement of the yarn caused by the additional load is constant at 10 mm/sec.

The length (l mm) of the movement of the yarn caused by the replacement of the additional load 26 is measured and the CF value calculated from the following equation.

$$\text{CF Value} = 1000/(l + 0.60)$$

UNWINDING TENSION

A sample yarn is unwound, at a speed of 300 m/min, from a yarn package through a yarn guide (a satin-finished and chrome-plated pin) provided at a distance of 150 mm from the yarn package, while changing the yarn running direction by 90° around the yarn guide. The unwinding tension is measured by a tensiometer provided downstream of the yarn guide.

The present invention will further be illustrated by the following illustrative, but not limitative, examples.

EXAMPLE 1

Figure 3:
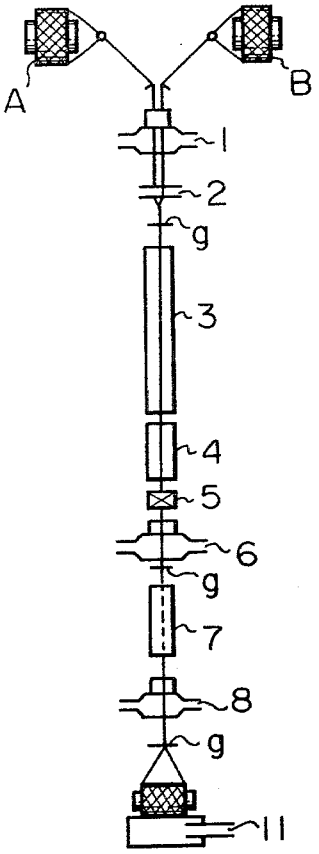
FIG. 3 is a schematic view of an apparatus usable for the practice of an embodiment of the process of the present invention.

Undrawn polyethylene terephthalate multifilament yarns of an intrinsic viscosity of 0.61, obtained by a usual melt spinning, were simultaneously drawn and false-twisted, in the various combinations as indicated in Table 2 below, using an apparatus as illustrated in FIG. 3. However, the second heater 7 was not heated. All of the undrawn yarns had a circular filament cross-section. The draw-texturing conditions were as follows.

Peripheral speed of feed roller (1) 200.0 m/min

Intertwisting regulative device (2) See Note a

| | |
|---|---|
| Intertwisting angles | $\theta$: 40°<br>$\theta'$: 42° |
| Length of first heater (3) | 2.0 m |
| Surface temperature of first heater (3) | 205° C.<br>See Note |
| False twister (5) | b |
| Number of false twists | 2340 T/M |

(Notes)
a: Textured rod of a diameter of 4 mm and a degree of surface roughness of 7 S
b: External friction false-twister having 3 shafts and 8 urethane rubber discs The properties of the obtained spun yarn-like textured yarns, and of fabrics obtained by dyeing and knitting the yarns were measured. The results are shown in Table 2.

TABLE 2

| | Run No. | | 1 | 2 | 3 | 4 | 5 | 6 | 7 | 8 |
|---|---|---|---|---|---|---|---|---|---|---|
| | Undrawn yarn A | | | | | | | | | |
| | Spinning speed | m/min. | 2,600 | 2,600 | 2,600 | 2,700 | 2,800 | 3,000 | 3,000 | 2,800 |
| | Total denier | denier | 133.6 | 133.1 | 133.0 | 133.7 | 134.1 | 134.3 | 134.5 | 133.9 |
| | Number of filaments | — | 36 | 48 | 96 | 62 | 62 | 36 | 62 | 62 |
| | Monofilament denier | denier | 3.71 | 2.77 | 1.39 | 2.16 | 2.16 | 3.73 | 2.17 | 2.16 |
| | NDR | % | 59.5 | 57.6 | 48.5 | 49.0 | 46.8 | 49.2 | 43.0 | 46.8 |
| Undrawn | Undrawn yarn B | | | | | | | | | |
| Yarn | Spinning speed | m/min | 3,000 | 3,000 | 3,000 | 3,000 | 3,000 | 2,600 | 2,700 | 3,000 |
| | total denier | denier | 136.4 | 136.4 | 134.1 | 134.1 | 134.1 | 133.3 | 134.6 | 132.6 |
| | Number of filaments | — | 24 | 24 | 18 | 18 | 18 | 24 | 18 | 18 |
| | Monofilament denier | denier | 5.68 | 5.68 | 7.45 | 7.45 | 7.45 | 5.54 | 7.48 | 7.37 |
| | NDR | % | 48.8 | 48.8 | 46.4 | 46.4 | 46.4 | 60.0 | 49.3 | 48.7 |
| | $\Delta[NDR]_{A-B}$ | % | 10.7 | 8.8 | 2.1 | 2.6 | 0.4 | −10.8 | −6.3 | −1.9 |
| Draw- | Draw ratio | | 1.75 | 1.75 | 1.75 | 1.75 | 1.75 | 1.75 | 1.75 | 1.75 |
| texturing | Processability*1 | | ◎ | ◎ | ◎ | ◎ | X | ◎ | ◎ | X |
| | Component yarn A | | | | | | | | | |
| | Total denier | denier | 72.4 | 71.4 | 73.7 | 74.1 | 75.6 | 78.1 | 78.6 | 78.1 |
| | Monofilament denier | denier | 2.01 | 1.49 | 0.77 | 1.20 | 1.22 | 2.17 | 1.27 | 1.26 |
| Textured | Component yarn B | | | | | | | | | |
| Yarn | Total denier | denier | 79.6 | 79.6 | 78.5 | 78.5 | 78.4 | 72.4 | 74.1 | 74.3 |
| | Monofilament denier | denier | 3.32 | 3.32 | 4.36 | 4.36 | 4.36 | 3.02 | 4.12 | 4.13 |
| | $\Delta[d]_{B-A}$ | denier | 1.31 | 1.83 | 3.59 | 3.16 | 3.14 | 0.85 | 2.85 | 2.87 |
| | Broken filament count | counts/m | 1.1 | 3.8 | 9.9 | 8.1 | 4.9 | 0.8 | 7.1 | 1.7 |
| | Crimp stretchability | % | 19.6 | 19.3 | 19.2 | 20.3 | 21.2 | 21.2 | 20.1 | 21.3 |
| | Difference in length | % | 6.3 | 5.5 | 1.4 | 1.8 | 0.5 | 5.8 | 4.4 | 0.8 |
| | Bulk factor | cc/g | 13.6 | 13.8 | 13.1 | 13.8 | 11.3 | 12.8 | 13.2 | 11.6 |
| | Softness*2 | — | X | ○ | ◎ | ◎ | ○ | X | ○ | ○ |
| Knitted | Fullness*3 | — | ◎ | ◎ | ○ | ○ | X | ◎ | ◎ | X |

TABLE 2-continued

| | Run No. | | 1 | 2 | 3 | 4 | 5 | 6 | 7 | 8 |
|---|---|---|---|---|---|---|---|---|---|---|
| Fabric | Pilling resistance*4 | class | 1~2 | 3~4 | 5 | 4~5 | 4~5 | 1~2 | 4~5 | 4~5 |

Notes:
*1The processability was evaluated based on the following criterion.
◎:Very good (Yarn breakage does not occur and no nep is observed)
○ :Good
X:Inferior
*2Softness was based on the following criterion.
◎:Very soft
○ :Soft
X:Harsh
*3Fullness was based on the following criterion.
◎:Very good
○ :Good
X:Inferior
*4The pilling resistance was evaluated using an ICI type pilling tester and graded based on the following 5 classes.
5:Very good (acceptable)
4:Fairly good (acceptable)
3:Good (acceptable)
2:Slightly inferior (not acceptable)
1:Inferior (not acceptable)
Run Nos. 1, 5, 6 and 8 are comparative.

In the monofilament denier of the component yarn A is large, the pilling resistance is inferior, as is seen from Run Nos. 1 and 6. Also, the softness is inferior and the borken filament count is fairly small.

As seen from Run Nos. 5 and 8, if the absolute value of $\Delta[NDR]_{A-B}$ is less than 2%, i.e. $\Delta[NDR]_{A-B}$ is 0.4% in Run No. 5 also and $\Delta[NDR]_{A-B}$ is −1.9% in Run No. 8, the bulk factor is relatively low. This is due to the low difference in length and, thus, the softness and fullness of the knitted fabirc are also realtively inferior.

The yarns obtained in Run Nos. 2, 3, 4 and 7 have desirable properties. The knitted fabrics from the yarns have a satisfactory softness, fullness and pilling resistance.

EXAMPLE 2

The procedure as described in Example 1, Run No. 4, was repeated, except that the filament cross-sections of the undrawn yarns A and B were varied as indicated in Table 3 below. Then, the obtained yarns were knitted into fabrics and the luster of the fabrics was evaluated. The results are shown in Table 3.

TABLE 3

| Run No. | 4 | 9 | 10 | 11 |
|---|---|---|---|---|
| Cross-sectional shape in undrawn yarn A | Circular | Circular | Circular | Octa-lobal |
| Cross-sectional shape in undrawn yarn B | Circular | Tri-lobal | Octa-lobal | Octa-lobal |
| Luster of knitted fabric | Slightly lustrous | Highly lustrous as in silk | Very slightly lustrous | Non-lustrous |

EXAMPLE 3

The procedure as described in Example 1, Run No. 3, was repeated, except that the doubling of the undrawn yarns was carried out as mentioned below. In Run No. 12, the doubling was effected upstream of the feed roller 1 of the apparatus illustrated in FIG. 3 and in Run Nos. 13 and 14, the doubling was effected by using the intertwisting regulative device 2, which was a textured rod of a diameter of 7 mm and a degree of surface roughness of 2.5 S, and by varying the intertwisting angles as indicated in Table 4 below. The results are shown in Table 4.

TABLE 4

| Run No. | Interwisting angles θ | θ' | Broken filament count (average) (counts/m) | Processability |
|---|---|---|---|---|
| 12 | — | — | 31.2–59.6 (46.8) | X |
| 13 | 14 | 64 | 1.3–5.0 (3.3) | ○ |
| 14 | 40 | 42 | 8.8–10.8 (9.9) | ◎ |

Run Nos. 12 and 13 are comparative. In Run No. 12, the broken filament count is not uniform and the processability is inferior. In Run No. 13, the broken filament count is also non-uniform.

EXAMPLE 4

The procedure as described in Example 1 was repeated, except that an apparatus as illustrated in FIG. 4 was used and substantial coherence was imparted, under the following conditions, before the taking up of the yarn. The results are shown in Table 5 below.

| | |
|---|---|
| Interlacing nozzle | Air of a pressure of 3.5 kg/cm$^2$ was blown against the yarn through a narrow opening at a flow rate of 21 normal liters/min. |
| Tension of yarn under innterlacing | 2.5 g |

TABLE 5

| | Run No. | | 15 | 16 | 17 | 18 | 19 | 20 | 21 | 22 |
|---|---|---|---|---|---|---|---|---|---|---|
| | Undrawn yarn A | | | | | | | | | |
| | Spinning speed | m/min | 2,600 | 2,600 | 2,600 | 2,700 | 2,800 | 3,000 | 3,000 | 2,800 |
| | Total denier | denier | 133.6 | 133.1 | 133.0 | 133.7 | 134.1 | 134.3 | 134.5 | 133.9 |
| | Number of filaments | — | 36 | 48 | 96 | 62 | 62 | 36 | 62 | 62 |
| | Monofilament denier | denier | 3.71 | 2.77 | 1.39 | 2.16 | 2.16 | 3.73 | 2.17 | 2.16 |
| | NDR | % | 59.5 | 57.6 | 48.5 | 49.0 | 46.8 | 49.2 | 43.0 | 46.8 |
| Undrawn Yarn | Undrawn yarn B | | | | | | | | | |
| | Spinning speed | m/min | 3,000 | 3,000 | 3,000 | 3,000 | 3,000 | 2,600 | 2,900 | 3,000 |
| | Total denier | denier | 136.4 | 136.4 | 134.1 | 134.1 | 134.1 | 133.3 | 134.6 | 132.6 |
| | Number of filaments | — | 24 | 24 | 18 | 18 | 18 | 24 | 18 | 18 |

TABLE 5-continued

| | Run No. | | 15 | 16 | 17 | 18 | 19 | 20 | 21 | 22 |
|---|---|---|---|---|---|---|---|---|---|---|
| | Monofilament denier | denier | 5.68 | 5.68 | 7.45 | 7.45 | 7.45 | 5.54 | 7.48 | 7.37 |
| | NDR | % | 48.8 | 48.8 | 46.4 | 46.4 | 46.4 | 60.0 | 49.3 | 48.7 |
| | $\Delta[NDR]_{A-B}$ | % | 10.7 | 8.8 | 2.1 | 2.6 | 0.4 | −10.8 | −6.3 | −1.9 |
| Draw-texturing | Draw ratio | | 1.75 | 1.75 | 1.75 | 1.75 | 1.75 | 1.75 | 1.75 | 1.75 |
| | Processability | | ◎ | ◎ | ◎ | ○ | X | ◎ | ◎ | X |
| | Component yarn A | | | | | | | | | |
| | Total denier | denier | 72.4 | 71.4 | 73.7 | 74.1 | 75.6 | 78.1 | 78.6 | 78.1 |
| | Monofilament denier | denier | 2.01 | 1.49 | 0.77 | 1.20 | 1.22 | 2.17 | 1.27 | 1.26 |
| Textured Yarn | Component yarn B | | | | | | | | | |
| | Total denier | denier | 79.6 | 79.6 | 78.5 | 78.5 | 78.4 | 72.4 | 74.1 | 74.3 |
| | Monofilament denier | denier | 3.32 | 4.36 | 4.36 | 4.36 | 3.02 | 4.12 | 4.13 | |
| | $\Delta[d]_{B-A}$ | denier | 1.31 | 1.83 | 3.59 | 3.16 | 3.14 | 0.85 | 2.85 | 2.87 |
| | CF value | — | 123 | 110 | 101 | 77 | 61 | 118 | 87 | 68 |
| | Broken filament count | counts/m | 0.7 | 1.7 | 8.7 | 7.8 | 6.0 | 0.8 | 7.9 | 2.7 |
| | Crimp stretchability | % | 18.5 | 18.2 | 17.0 | 19.6 | 19.1 | 19.3 | 19.0 | 19.6 |
| | Unwinding tension | g | 7 | 7 | 6 | 6 | 5 | 6 | 7 | 6 |
| | Bulk factor | cc/g | 12.2 | 11.9 | 12.3 | 11.2 | 10.2 | 12.1 | 12.1 | 10.4 |
| | Softness | — | X | ○ | ○ | ◎ | ○ | X | ◎ | ◎ |
| Knitted Fabric | Fullness | — | | ◎ | ◎ | ○ | X | ◎ | ◎ | X |
| | Pilling resistance | class | 1~2 | 3~4 | 5 | 4~5 | 4~5 | 1~2 | 4~5 | 4~5 |

What is claimed is:

1. A spun yarn-like textured yarn comprised of two types of polyester multifilament component yarns A and B, the difference in monofilament denier $\Delta[d]_{B-A}$ of the component yarn B from the component yarn A being not less than 1.8 denier, the monofilament denier of the component yarn A being not more than 1.6 denier, and the textured yarn having a broken filament count of not more than 40 per meter of its length, a crimp stretchability of not more than 23%, a difference in length between the component yarns A and B of not less than 1% and a bulk factor of not less than 9 cc/g.

2. A textured yarn according to claim 1, wherein the broken filament count is in a range of from 3 to 25 per meter.

3. A textured yarn according to claim 1, wherein the crimp stretchability is in a range of from 15 to 22%.

4. A textured yarn according to claim 1, wherein the difference in length is in a range of from 3 to 12%.

5. A textured yarn according to claim 1, wherein the bulk factor is in a range of from 9 to 18 cc/g.

6. A textured yarn according to claim 1, wherein the textured yarn is made substantially coherent.

7. A textured yarn according to claim 1, 2, 3, 4, 5 or 6, wherein at least the component yarn B is made of filaments having a tri-lobal to octo-lobal cross-section.

8. A process for producing a spun yarn-like textured yarn as defined in claim 1, which comprises:

passing two types of undrawn polyester multifilament yarns A and B, the difference in NDR $\Delta[NDR]_{A-B}$ of the undrawn yarn A from the undrawn yarn B being not less than 2% or not more than −2%, the monofilament denier of the undrawn yarn A being small enough to be drawn to a monofilament denier of not more than 1.6 denier, the monofilament denier of the undrawn yarn B being greater than the monofilament denier of the undrawn yarn A, separately through a feed roller;

simultaneously draw-texturing the undrawn yarns A and B together while doubling them with substantially identical intertwisting angles immediately after passing through an intertwisting regulative device provided between the feed roller and a heater for fixing the twists, whereby the difference in monofilament denier $\Delta[d]_{B-A}$ of the yarn B from the yarn A is made not less than 1.8 denier, the monofilament denier of the yarn A is made not more than 1.6 denier and some of the individual filaments of the yarn A are partially cut to produce broken filaments, and;

taking up the draw-textured yarns A and B together.

9. A process according to claim 8, wherein at least the undrawn yarn B is made of filaments having a tri-lobal to octa-lobal cross-section.

10. A process according to claim 8 or 9, wherein substantial coherence is imparted to the draw-textured yarns before they are taken up.

* * * * *

UNITED STATES PATENT AND TRADEMARK OFFICE

CERTIFICATE OF CORRECTION

PATENT NO. : 4,292,799

DATED : October 6, 1981

INVENTOR(S) : Yukio Otaki et al

It is certified that error appears in the above—identified patent and that said Letters Patent is hereby corrected as shown below:

Column 1, line 30 after "As" insert --methods-- line 37, after "Pat." insert --Specification-- line 43, after "Pat." insert --Specification--

Column 4, line 45, after "Pat." insert --Publications--

Column 7, line 8, after "Pat." insert --Specification--

Column 12, Table 2, Processability, column 4, "◎" should be --○--

Column 15, Table 5, Knitted Fabric, Fullness delete all symbols and insert in column 15 --◎--; column 16 --◎--; column 17 --○--; column 18 --○--; column 19 -- X --; column 20 --◎--; column 21 --◎--; column 22 -- X --

Signed and Sealed this

Thirtieth Day of March 1982

[SEAL]

Attest:

GERALD J. MOSSINGHOFF

Attesting Officer

Commissioner of Patents and Trademarks